United States Patent [19]

Scheidegger et al.

[11] 4,350,494

[45] Sep. 21, 1982

[54] PROCESS FOR THE DYEING OF TEXTILE MATERIAL AND APPARATUS FOR CARRYING OUT THE PROCESS

[75] Inventors: Hans Scheidegger, Binningen, Switzerland; Hermann Flensberg, Weil am Rhein, Fed. Rep. of Germany; Roland Bauhofer, Böckten, Switzerland

[73] Assignee: Ciba-Geigy Corporation, Ardsley, N.Y.

[21] Appl. No.: 230,150

[22] Filed: Jan. 30, 1981

Related U.S. Application Data

[63] Continuation of Ser. No. 935,830, Aug. 22, 1978, abandoned, which is a continuation of Ser. No. 755,699, Dec. 30, 1976, abandoned.

[30] Foreign Application Priority Data

Jan. 6, 1976 [CH] Switzerland ..... 51/76

[51] Int. Cl.[3] ..... D06P 1/39; D06P 3/06

[52] U.S. Cl. ..... 8/636; 8/929; 8/158

[58] Field of Search ..... 8/633, 634, 620, 636, 8/929

[56] References Cited

U.S. PATENT DOCUMENTS

| | | | |
|---|---|---|---|
| 2,900,218 | 8/1959 | Gray | 8/602 |
| 3,317,271 | 5/1967 | Mecco | 8/929 |
| 3,352,624 | 11/1967 | Harding et al. | 8/481 |
| 3,627,473 | 12/1971 | Eltonhead | 8/531 |
| 3,936,268 | 2/1976 | Papalos | 8/589 |

FOREIGN PATENT DOCUMENTS

| | | | |
|---|---|---|---|
| 2361491 | 12/1963 | Fed. Rep. of Germany . | |
| 161381 | 6/1971 | Fed. Rep. of Germany . | |
| 605258 | 7/1948 | United Kingdom | 8/524 |
| 1404545 | 9/1975 | United Kingdom . | |
| 1450216 | 9/1976 | United Kingdom . | |
| 1458632 | 12/1976 | United Kingdom . | |

OTHER PUBLICATIONS

Nitschke, G., VEB Verlag Technik 1954, pp. 63–66.
Weckler, G., Meilland 11, 1963, pp. 1224–1239.

*Primary Examiner*—Maria Parrish Tungol
*Attorney, Agent, or Firm*—Edward McC. Roberts

[57] ABSTRACT

Described is a process for the dyeing of textile material by the exhaust method, whereby the dyeing is commenced at a pH value of between 6 and 12 and terminated at a pH value of between 3 and 7, which process is characterized in that during dyeing the pH value is lowered, by the addition of an inorganic acid, by at least 1 unit of pH value; and that subsequent to the dyeing the exhausted bath, after the addition of alkali, dye and, if required, further auxiliaries, is optionally used afresh for dyeing.

Furthermore an apparatus for carrying out this process is described which consists of a dyeing aggregate having a liquor-circulating system which contains at least one pH-measuring point as well as at least one dosing device.

10 Claims, 4 Drawing Figures

Figure 1:
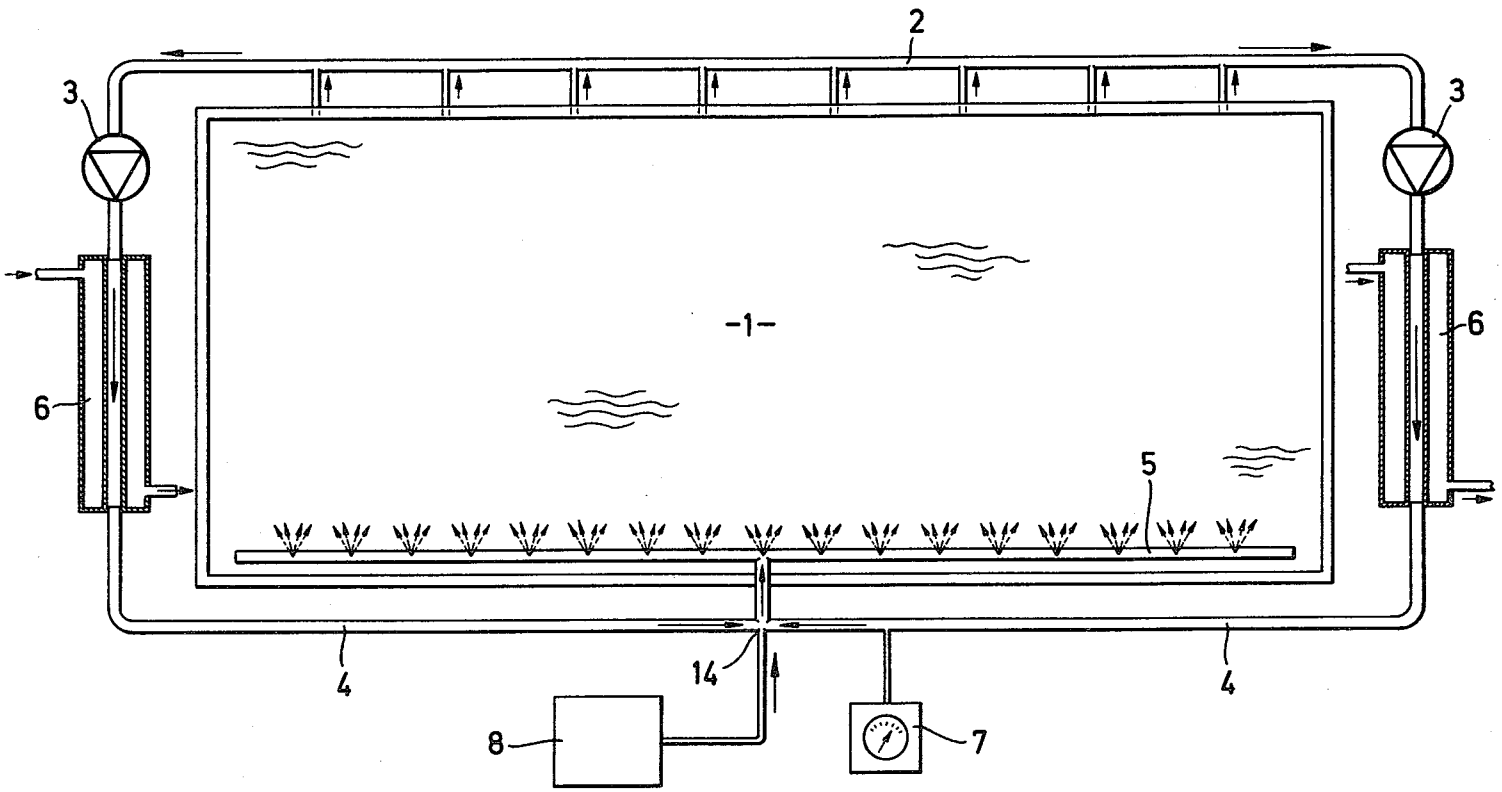
Figure 2:
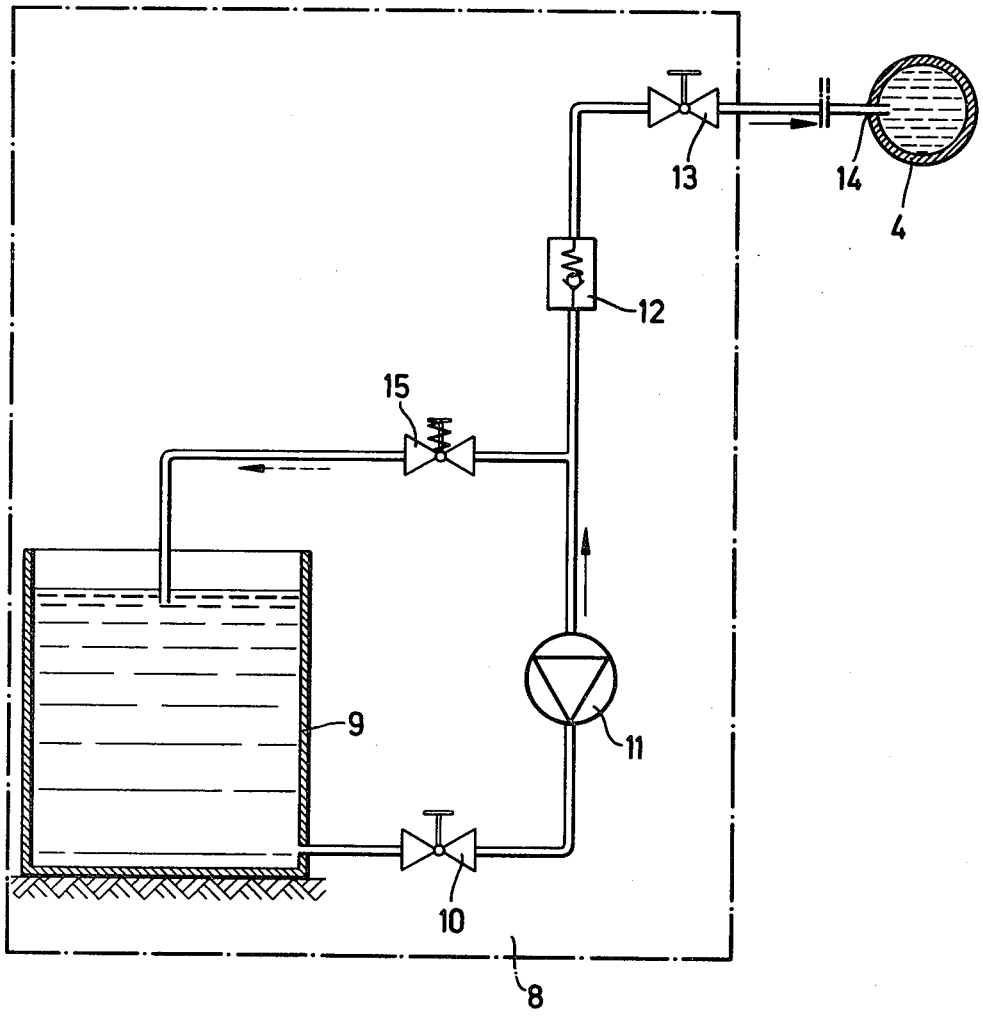
Figure 3:
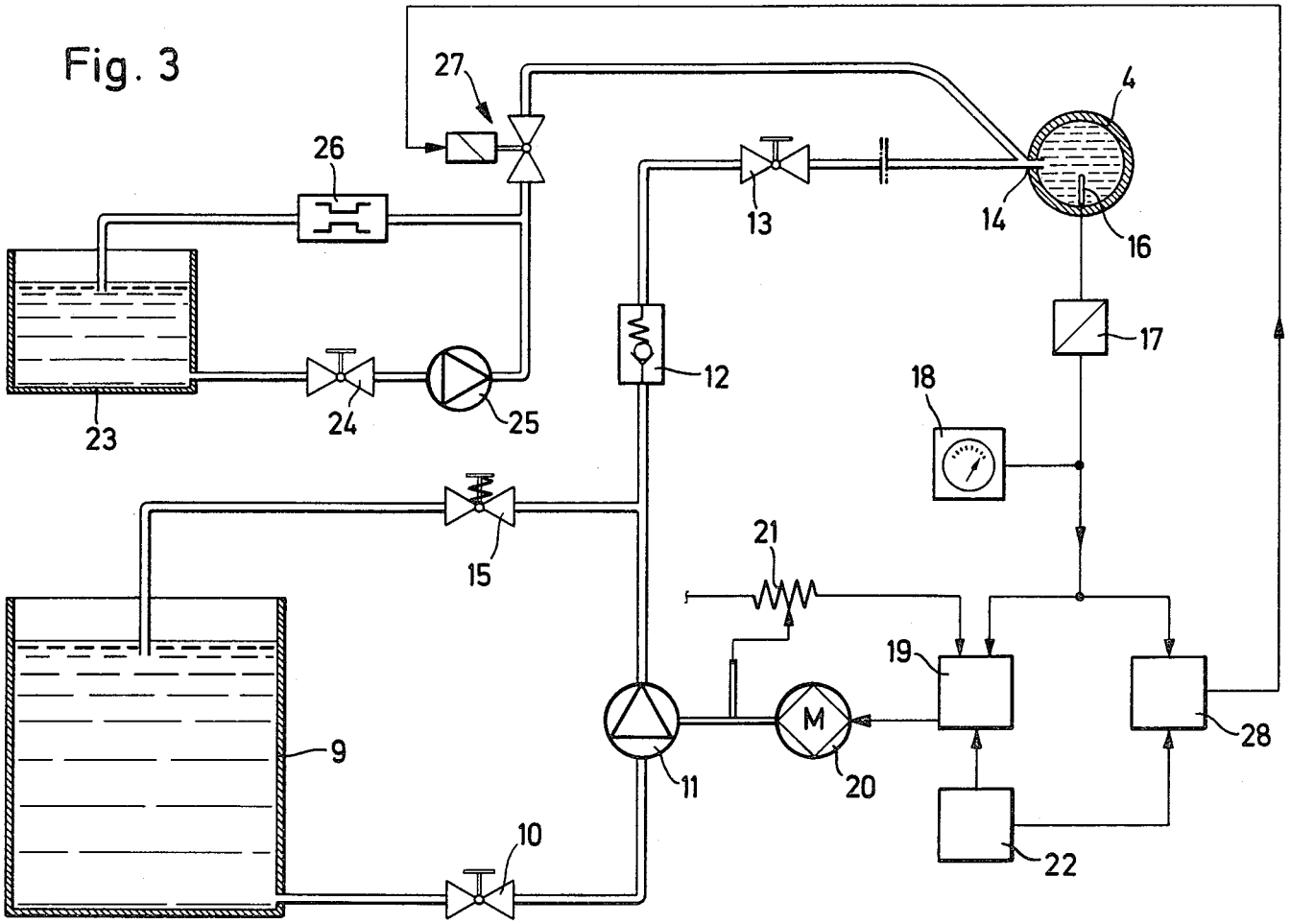
Figure 4:
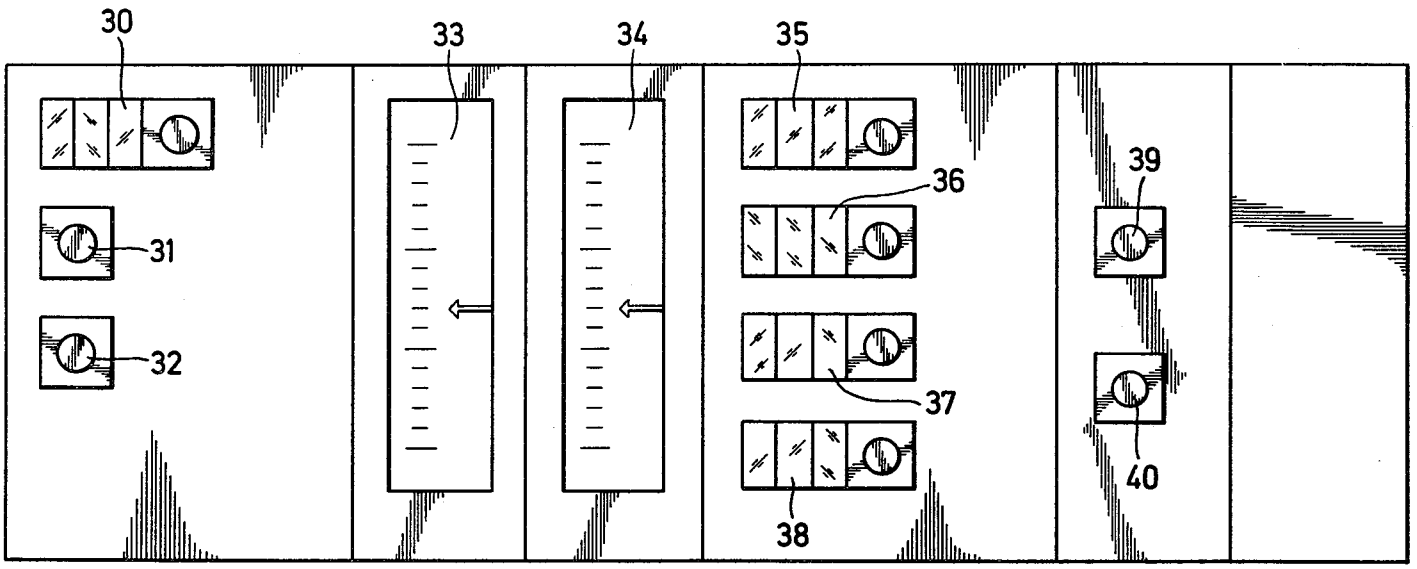

PROCESS FOR THE DYEING OF TEXTILE MATERIAL AND APPARATUS FOR CARRYING OUT THE PROCESS

This is a Continuation of application Ser. No. 935,830 filed on Aug. 22, 1978, now abandoned which in turn is a Continuation of application Ser. No. 755,699 filed Dec. 30, 1976, now abandoned.

The present invention relates to a process for the level, rational, reliable and environmentally favourable dyeing of textile material by the exhaust method, to the aplication of the process to textile material made principally from fibres that can be dyed with anionic dyes, such as synthetic polyamide or wool, to the textile material dyed by this process, as well as to the apparatus for carrying out the process.

Textile material that can be dyed with anionic dyes, such as synthetic polyamide or wool, is usually dyed from a more or less buffered, slightly alkaline, neutral or weakly acid bath. Towards the end of dyeing, there is sometimes added an organic acid, such as acetic acid; the degree of exhaustion is certainly improved as a result, but problems frequently arise with regard to the levelness of the dyeings.

The use of sulphuric acid is not advised because, although the degree of exhaustion is further improved as a result, the risk of obtaining unlevel dyeings by virtue of blocking effects is particularly great [see H. U. Schmidlin: Vorbehandlung und Färben von synthetischen Faserstoffen (Preliminary treatment and dyeing of synthetic fibre materials), Publishers: Schweizerische Vereinigung von Färbereifachleuten (Swiss Association of Dyeing Specialists), Basle 1968].

The German 'Offenlegungsschrift' No. 2,354,728 discloses a process for dyeing wool and polyamide, wherein dyeing is commenced at a pH value of 7.5 to 11 and completed at a pH value of 4 to 6.5. The change in the pH value is achieved by addition of lactones as acid donators, which during the dyeing process are continuously hydrolysed. In this Offenlegungsschrift the use of free acids instead of the lactones is not advised since the levelness would be impaired, particularly in the case of light dyeings.

These known processes possess however the great disadvantage that after each dyeing there have accumulated large amounts of waste liquor, which have to be freed from dyes and in some cases from textile auxiliaries. A re-utilization of the dyebath is possible only with difficulty because too much of the dyes, auxiliaries and unconsumed acid donators remain in the bath after dyeing. Furthermore, because of the weak organic acid in conjunction with the alkali necessary for obtainment of the initial pH value, there would be formed in the dyebath a buffer system, so that with renewed acidification, the final pH value could be obtained only by the addition of considerably greater amounts of acid donators.

It has now been found that it is possible, without extra dyeing or analytical expenditure, with the attainment of very reproducible dyeings, to repeatedly use the dyebath if measures are taken to ensure that the dyes are absorbed as completely as possible onto the textile material. This is achieved by lowering the pH value of the dyebath by the addition of a strong acid during the course of dyeing. The difficulties with respect to the levelness of the dyeings can be surprisingly avoided by virtue of the addition of acid being made gradually.

The process according to the invention offers a considerable advance in the art. The amount of waste liquor is greatly reduced by the repeated use of the dyebath. Moreover, in consequence of the better degree of exhaustion the waste liquors contain an amount of dye that is appreciably less than that contained by the baths remaining after the customary processes, and there are required no buffer systems containing phosphates or borates, which are ecologically unsafe. As a consequence of the use of inorganic acids instead of organic acids, it is also possible to reduce the oxygen requirement for the biological purification of the waste liquors. The result is therefore a considerable saving of water, of dyes and of other auxiliary chemicals, as well as of energy, since the exhausted dyebaths on repeated use do not have to be reheated each time from room temperature to the dyeing temperature. It is merely necessary to compensate for cooling which, even with the use of a device for hot withdrawal, occurs whilst the material is being changed.

In addition, the process according to the invention has the particular advantage that dyeings are obtained which, even after repeated use of the bath, have very good reproducibility with regard to depth of colour and shade; and, furthermore, the results of small-scale tests (laboratory dyeings) can be excellently related to dyeings on a commercial scale.

Because of the high degree of exhaustion of the dyes, a rinsing process is in many cases unnecessary, which constitutes a further rationalisation.

The present invention hence relates to a process for the level, rational, reliable and environmentally favourable dyeing of textile material by the exhaust method, whereby the dyeing is commenced at a pH value of between 6 and 12 and terminated at a pH value of between 3 and 7, which process is characterised in that at the commencement of dyeing the initial pH value is adjusted if necessary by the addition of strong alkali; that during dyeing the pH value is lowered, by the addition of a strong inorganic acid, by at least 1 unit of pH value; and that subsequent to the dyeing the exhausted bath, after the addition of alkali, dye and, if required, further auxiliaries, is optionally used afresh for dyeing.

A preferred embodiment of the invention comprises commencing the dyeing at a pH value of 7.0 to 10.0 and terminating it at a pH value of 3.5 to 6. The pH value to be applied depends essentially on the type and concentration of the dyes, on the substrate and on the type of dyeing aggregate. These pH values are known or are readily determinable.

To the dyebath are subsequently added alkali, optionally auxiliaries, and dyes and the dyebath is used afresh for dyeing. Suitable alkalies are salts of strong bases with weak acids, e.g. ammonium carbonate, sodium carbonate or potassium carbonate or ammonium hydrogen carbonate, sodium hydrogen carbonate or potassium hydrogen carbonate, as well as preferably strong bases such as NaOH or KOH, which are added optionally all at once, portionwise or preferably in controlled amounts.

The lowering of the pH value during dyeing is effected by the addition of a strong inorganic acid of which the $pK_a$ value at 20° C. is below 3.8. Suitable inorganic acids are, in particular, nitric acid, hydrochloric acid and especially sulphuric acid.

The acid is added to the dyebath, preferably after attainment of the dyeing temperature, in such a manner that a level dyeing results.

The addition of acid can be made, for example, within 5 to 90 minutes in 5 to 15 equal portions, or continuously, e.g. with a constant rate of feed. It is also possible to feed in the acid in 2 or more phases, the rate of flow for each phase being constant but differing from one phase to another; and also to have pauses in between during which no addition of acid is made. It is advantageous however to perform the addition of acid by means of a suitable regulating and/or control device, e.g. in such a way that there occurs a predetermined pH variation relative to time and /or to temperature. This pH variation can follow one or more linear and/or nonlinear gradients.

Textile materials made up of material dyeable with anionic dyes can be dyed by the process according to the invention. The process can be used, in particular, for dyeing natural polyamides, such as wool or silk, or synthetic polyamides. Such synthetic polyamides are, e.g., polymers of ε-caprolactam (polyamid 6), condensation products from hexamethylenediamine and adipic acid (polyamide 6.6) or sebacid acid (polyamide 6.10), or mixed condensation products, e.g. from hexamethylenediamine, adipic acid and ε-caprolactam (polyamide 6.6/6), also the polymerisation products from ε-caprolactam or from ω-aminoundecanoic acid (polyamide 11), and modified polyamide types. Also applicable are mixtures of these fibres, and also of wool and synthetic polyamide. The make-up of these fibre materials can be very varied; they can be for example in the form of loose material, yarn in all forms of make-up, fabrics, knitted fabrics, knitwear, fibre fleece materials and, in particular, carpets.

Dyes usable according to the invention are preferably anionic, water-soluble or at least dispersible in water. They can be reactive or preferably nonreactive, i.e. they are able or not able to form with the fibre material a covalent bond, and they can belong to different classes of dyes. They are, for example, salts of metal-free or heavy-metal-containing mono-, dis- or polyazo dyes, including the formazan dyes, as well as anthraquinone, nitro, triphenylmethane and phthalocyanine dyes. Of interest are also the 1:2 metal-complex dyes. The anionic character of these dyes can be caused by metal-complex formation alone and/or by acid salt-forming substituents, such as carboxylic acid groups, sulphuric acid groups and phosphoric acid ester groups, phosphoric acid groups or sulphonic acid groups.

In addition, the dyebath can contain disperse dyes and/or cationic dyes. All these dyes must be essentially stable in the pH range in which dyeing is performed.

For this form of application, namely the dyeing of, e.g., differentially-dyeing polyamide carpet material or possibly of other types of fibres, the process has considerable technical advantages. Since, as is known, the migration of dyes and also the differentiation effect, which are responsible for surface levelness, are very greatly dependent on the pH value, and since for these two phenomena also different pH values are optimum, the selection of the pH value in the process applied hitherto has been very limited by the choice of the buffer systems available. Furthermore, certain buffer systems, e.g. phosphates or acetic acid/sodium acetate) are ecologically undesirable.

It has now been found that with the present process, which permits of a controled adjustment of the pH value from a higher value to a stable lower final value, it is possible to achieve clearly better reliability in respect of surface levelness, reproducibility in shade of colour, depth of colour and degree of differentiation. This results in an appreciable reduction of the effective average dyeing time and in a simplification of the process. The final pH value can moreover be freely chosen and maintained constant, so that consequently there is much greater flexibility with respect to choice of dyes.

Besides the dyes, the dyebath may contain additives which influence the properties of the textile material, e.g. levelling agents, softening agents, antistatic agents, antioxidants, antimicrobial agents, additives producing a flameproof finish or improving the hydrophilic properties, and dirt-, water- and oil-repelling agents, additives for increasing fastness to wet-processing as well as antifoam agents.

The dyeing process according to the invention is performed preferably at elevated temperature, especially at 65° to 100° C. It is however also possible to dye in pressure-tight apparatus at a temperature up to 140° C., preferably at 100° to 120° C.

In general also circulation dyeing apparatus or circulation dyeing machines, such as jet dyeing machines, circulation apparatus for yarn or wound packages, beam dyeing machines, pack dyeing machines, winch vats or dyeing aggregates, onto which is constructed specifically for the said purpose an external circulation system, can be used for the process according to the invention.

The procedure is for example such that dyes and, optionally, an anionic auxiliary are added to the cold bath and, by means of the dosing device, alkali is allowed to flow into the bath until the desired initial pH value (6 to 12) is obtained; the textile material is then fed in and the bath is heated to the dyeing temperature, preferably 90° to 100° C. The procedure can however be reversed by firstly introducing into the dyeing apparatus the alkaline dye liquor together with the textile material to be dyed, and then adding the dyes and, optionally, auxiliaries.

During the absorption period, the pH value can for example be maintained constant by means of the dosing device. After attainment of the dyeing temperature, dyeing is performed for 5 to 60 minutes, preferably for about 30 minutes. The pH value is then lowered by means of the dosing device to the final value (7 to 3.5) within 5–90 minutes. The acid preferably used is sulphuric acid. The dyes are practically completely absorbed, e.g. to the extent of over 99%, onto the textile material. This is removed, e.g. after cooling, preferably however at the dyeing temperature, from the dyeing apparatus and subsequently finished, e.g. without rinsing, by centrifuging, by subjecting it to suction or by drying.

Into the used, preferably hot, dye liquor are now introduced dyes, optionally auxiliaries, and, by means of the dosing device, alkali. After attainment of the desired initial pH value, textile material is again fed into the dyeing apparatus and the dyeing process described above is repeated.

In principle the liquor can be used in this manner as often as desired. Preferably, however, it is discarded after 2 to 6 applications, since possibly difficulties can arise, e.g. due to the removal of dressing or brightening agents, marking inks or impurities from the textile material, or due to the accumulation of fluff.

As a result of the almost complete absorption of the dye, it is possible to use for the second application of the liquor dyes other than those used for the first dyeing. Preferably, however, the lightest dyeings in each case will be performed first.

The present invention concerns, apart from the dyeing process, also an apparatus for performing this process. This comprises a suitable dyeing aggregate, on which are provided arrangements which enable the pH value of the dye liquor to be measured, and also at least one dosing device by means of which additives can be introduced into the dye liquor, such as, in particular, the acid and alkali required for carrying out the process according to the invention. Preferably, both the pH-measuring points and the dosing devices are connected to an external liquor-circulation system, with the pH-measuring points being located in the direction of flow in front of and/or behind a dosing device.

In a preferred arrangement of the apparatus according to the invention, the external liquor-circulation system consists of several separate pipe lines which are joined in front of the point of discharge into the dyeing apparatus; and the inoculating point, at which the dosing device is connected to the liquor-circulation system, is located at the point at which the individual pipe lines join, with this dosing device being so designed that, by means of a controlled pump, an initial pH value can be obtained by the regulated addition of a strong alkaline solution and subsequently, by means of a controlled pump (closed loop control) giving a measured addition of a strong acid, the pH value can be lowered, after a predetermined function of time, to a final value.

The dosing device can however be connected at another point to the liquor-circulation system, and the dosing device and the pH-measuring point can be situated both on the same pipe line and on different pipe lines of the liquor-circulation system.

It is obvious that the described types of apparatus merely constitute exemplified embodiments, and that the dyeing process can be carried out also with other types of apparatus.

The following Examples serve to illustrate the invention without its scope being limited to them. The quantity values in the case of the dyes and auxiliaries relate to commercial material, and the temperatures are in degrees Centigrade.

EXAMPLE 1

A laboratory winch vat having a working width of 55 centimeters and a capacity of 500 liters is equipped with an external liquor-circulation system. The liquor is drawn up from the bottom of the vat and, by means of a pump, is fed through a pipe line, which is fitted with a flowmeter, back to the winch vat at its front end. Between the drawing-off outlet and the pump there are provided in the pipe line three drilled holes. Into the first hole in the flow direction is inserted a combined glass electrode. The second hole is connected via a tube direct to the dosing pump, and onto the third hole is mounted an additive container with tap, through which dye and solutions of chemicals can be introduced.

The winch vat is charged with a piece of polyamide-6 velvet pile carpet (Allyn 707), 50 cm in width, 23 m in length and 6.45 kg in weight, as well as with 240 liters of cold softened water. The turning rate of the carpet material is 12 meters per minute, and the delivery of the pump for the external liquor circulation is adjusted to 3600 liters/hour.

From the container there are added to the liquor, whilst this is heated with steam directly to 80° to 85°, 100 ml of 1 N sodium hydroxide solution and subsequently 96.75 g of the surface-active agent of the formula

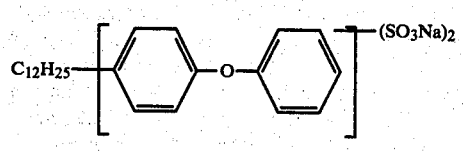

dissolved in 1 liter of water, whereupon the pH value is 10.5.

There are then introduced from the additive container, within 10 minutes, 4.84 g of the yellow dye of the formula I

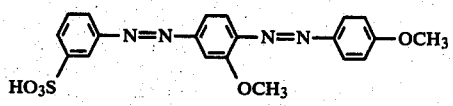

(I)

and 1.61 g of the blue dye of the formula II

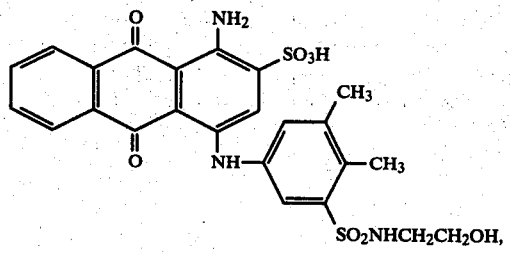

(II)

both dissolved in 1.5 liters of water. The temperature of the liquor is simultaneously raised by means of direct and indirect steam to 93° to 96° and is subsequently maintained at this level.

Ten minutes after this temperature has been reached and the dyes have been added, a controlled addition is made by means of the dosing pump, at a rate of 50 ml per minute, of 1200 ml of 1 N sulphuric acid. The pH value of the liquor is afterwards 3.9. It increases during the next 10 minutes to 4.4. The liquor is practically exhausted, i.e. the dyes are absorbed to the extent of over 99%. The heating is shut off and the bath is cooled to 60° by opening of the winch vat and indirect cooling.

The carpet material is removed from the winch vat and, without rinsing, centrifuged and dried. It is levelly dyed light green.

Into this used liquor, which has a temperature of 58° and in which the loss of liquor has been approximately compensated for by the direct-steam condensate, is introduced, after the addition of 500 ml of 1 N sodium hydroxide solution and 98.25 g of an anionic levelling agent having affinity for the fibres, 6.55 kg (0.5×23 m) of the same carpet material. The pH value of the liquor is 11.2. The turning rate of the carpet material is again 12 meters per minute and the liquor-circulation rate is adjusted to 4800 liters per hour.

The bath is now heated within 10 minutes to 93° to 96°; and there is then introduced by means of the additive container, in the course of 6 minutes, a solution of 4.91 g of the dye of the formula I and 1.64 g of the dye of the formula II in 1.5 liters of water. The temperature of the liquor is kept at 93° to 96°.

After a further 10 minutes is added by means of the dosing pump, at a rate of 20 ml per minute, 570 ml of 1 N sulphuric acid. The pH value of the liquor after the dosing pump has been turned off is 3.9, but increases to 4.25 in the course of the next 10 minutes. The dyes are absorbed onto the carpet material to the extent of over 99%. The liquor is cooled to 65°, the carpet material is removed from the winch vat and, without rinsing, centrifuged and dried. It is levelly dyed light green and cannot be distinguished in depth of colour and in shade from the material firstly dyed.

Into the liquor already used twice is introduced 5.94 kg (0.5×18 m) of an uncut pile carpet material, the loops of which are composed of a 50:50 mixture of basic dyeable polyamide (Antron 3 type 754) and deep-dyeing polyamide (Antron 3 type 757). There is then added at 60°, through the additive container within 5 minutes, 59.4 g of a nonionic levelling agent having affinity for the dyes (alkylamine polyglycol ether), dissolved in 1 liter of water, with the turning rate of the carpet being 12 m per minute and the circulation rate of the liquor 4800 liters per hour. The bath is heated within 15 minutes to 93° to 96° and kept at this temperature. During the heating up, 500 ml of 1 N sodium hydroxide solution is added; and on attainment of the final temperature are added in the course of 8 minutes, by way of the additive container, 20.79 g of the dye of the formula I, 8.91 g of the dye of the formula II and 3.56 g of the red dye of the formula III

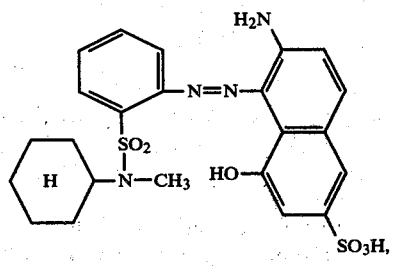

(III)

dissolved in 1 liter of warm water. There are subsequently added in the form of their dispersions, diluted in 1 liter of water and fed in from the additive container, 65.34 g of the yellow dye of the formula IV

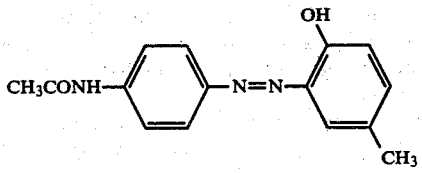

(IV)

0.71 g of the red dye of the formula V

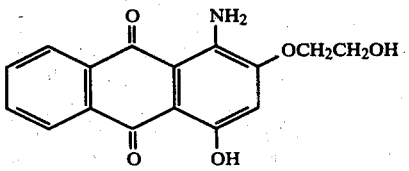

(V)

and 2.67 g of the blue dye of the formula VI

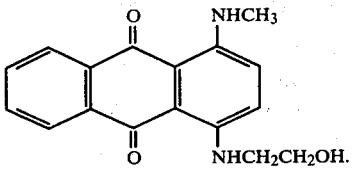

(VI)

After 10 minutes is added by means of the dosing pump, at a rate of 20 ml per minute, 580 ml of 1 N sulphuric acid. The pH value of the liquor 10 minutes after completing the addition of the acid is 4.1. After cooling to 60° C., the liquor is drawn off and the carpet material is rinsed in the winch vat with 200 liters of water at 50° for 15 minutes. The carpet material is removed from the winch vat, centrifuged and dried. The result obtained is a level differential dyeing in an olive and golden-yellow shade.

EXAMPLE 2

A beam dyeing machine (laboratory piece-dyeing machine, Model 10, Rudolf Then) consists with regard to its main parts of the horizontal dyeing vat with cooling jacket, which vat is connected with the auxiliary vat by way of a special return pump to form a circulation system.

Into this dyeing machine is introduced a piece beam charged with a polyamide-6 uncut pile carpet material, 50 cm in width, 135 cm in length and 380 g in weight. Six liters of softened water and 60 ml of 2 N sodium hydroxide solution are fed into the auxiliary vat. By opening of the appropriate valves (auxiliary vat, or connecting pipe, pump/dyeing vat) the liquor flows by its own drop from the auxiliary vat into the dyeing vat, with the expelled air passing through the vent pipe to the auxiliary vat. After filling of the dyeing vat, there remains in the auxiliary vat a liquor residue to a depth of about 5 cm; the circulation pump is then switched on. For measurment of the pH value, a drilled hole had been provided in the piping between the dyeing vat and auxiliary vat (flow direction) and a combined glass electrode inserted. The dye liquor circulates during the entire dyeing process from the inside to the outside, during which process the pressure drop is 0.1–0.2 bar and the delivery of the pump is about 6 liters per minute. The liquor is heated to 98° and 7.6 g of an anionic levelling agent having affinity for the fibres, dissolved in 100 ml of water, is fed in the course of 5 minutes into the auxiliary vat.

The dyeing temperature is adjusted to 97°–98° and the pH value is 10.7. The pH value of a sample taken and cooled to 20° is 11.9.

There are then introduced into the auxiliary vat in the course of 10 minutes from a dropping funnel 2.28 g of the yellow dye of the formula VII

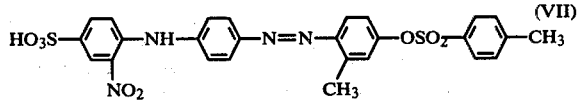

(VII)

and 1.52 g of the blue dye of the formula VIII

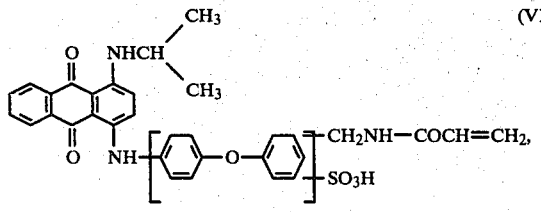

(VIII)

both dissolved in 200 ml of hot water. After 30 minutes, an addition is made by means of a flask burette, for 10 minutes at the rate of 5.5 ml per minute and for a further 20 minutes at the rate of 2.25 ml per minute, of a total amount of 100 ml of 1 N sulphuric acid.

The pH value after a further 10 minutes is 3.8. The dyebath is exhausted, i.e. the dyes have been absorbed to the extent of over 99% onto the material being dyed. The heating is switched off and, with the aid of indirect cooling, the dye liquor is cooled to 60°. During this time the pH value increases to 3.9. The liquor, almost as clear as water, is pumped back into the auxiliary vat and the piece beam is taken out. The carpet material is unwound, centrifuged and dried. The polyamide-6 loop pile carpet material has been evenly dyed in a green shade.

The used liquor, which is at a temperature of 55°, is made up with 600 ml of softened water again to 6 liters, thus compensating for the loss of liquor. The piece beam is wound with 380 g (50×135 cm) of the same polyamide-6 loop pile carpet material and is introduced into the dyeing machine. After the addition of 63 ml of 1 N sodium hydroxide solution to the liquor, the pH value is 11.0. The liquor is subsequently transferred as in the case of the preceding dyeing to the dyeing vat and, in the same manner, the identical amount of levelling agent is added. The dyeing temperature is adjusted to 97° to 98° and the pH value is 10.2.

2.28 g of the dye of the formula VII and 1.52 g of the dye of the formula VIII, both dissolved in 200 ml of hot water, are now fed from a dropping funnel, within 10 minutes, into the auxilary vat. After a further 30 minutes, an addition is made by means of a flask burette, for 10 minutes at a rate of 5.5 ml per minute and for a further 20 minutes at a rate of 1.4 ml per minute, of a total amount of 73 ml of 1 N sulphuric acid. The pH value after a further 10 minutes is 3.9. The pH value is continuously checked by means of the combined glass electrode mounted between the dyeing vat and auxiliary vat. The dyebath is exhausted, i.e. the dyes have been absorbed to the extent of over 99% onto the material being dyed. The heating is switched off and with the aid of indirect cooling the dye liquor is cooled to 60°, during which time the pH value has risen to 4.0. The almost exhausted liquor is pumped back into the auxiliary vat and the piece beam is taken out. The carpet material is unwound and, without being rinsed, is centrifuged and dried. The polyamide-6 loop pile carpet material is evenly dyed in a green shade and, with regard to depth of colour and shade, does not differ from the initially dyed carpet material.

Corresponding to this second dyeing, two further dyeings are performed on the same polyamide-6 carpet material, with small differences in weight being taken into account in fixing the weighed amounts of dyes and auxiliaries. The applied amounts of 1 N sodium hydroxide solution and also the dosing rates for the flask burette, which again contains sulphuric acid, are unchanged. Level dyeings are obtained which, in shade and depth of colour, do not differ from the first two dyeings.

EXAMPLE 3

The piece beam of the beam dyeing machine (see Example 2) is wound with a polyamide-6.6 serge filament fabric, which is fixed and bleached, 20×0.5 m in size and 670 g in weight. This piece beam is introduced into the dyeing vat. Six liters of cold softened water and 12 ml of 1 N sodium hydroxide solution are fed into the auxiliary vat. A combined glass electrode (see Example 2) enables the pH value to be measured. The liquor is subsequently transferred, as described in Example 2, to the dyeing vat, and 6.7 g of the same levelling agent is added. The dyeing temperature is adjusted to 97° to 98° and the pH value is 9.4.

5.36 g of the dye of the formula I, 2.28 g of the dye of the formula II and 2.28 g of the dye of the formula III according to Example 1, together dissolved in 200 ml of hot water, are fed in the course of 10 minutes from a dropping funnel into the auxiliary vat. After 15 minutes, an addition is made by means of a flask burette, at a rate of 2.5 ml per minute for 20 minutes, of 50 ml of 1 N sulphuric acid.

The pH value after a further 10 minutes is 4.2. The dye bath is exhausted, i.e. the dyes have been absorbed to the extent of over 99% onto the material being dyed. The heating is switched off and, with the aid of indirect cooling, the dye liquor is cooled to 60°. The liquor, almost as clear as water, is pumped back into the auxiliary vat and the piece beam is taken out. The filament fabric is unwound, dewatered by squeezing and dried. The fabric is levelly dyed in a brown shade.

The used liquor, which is at a temperature of 55°, is made up with 900 ml of softened water again to 6 liters, thus compensating for the loss of liquor. The piece beam is wound with 670 g (20×0.5 m) of the same polyamide-6.6 serge filament fabric and introduced into the dyeing machine. As in the case of the preceding dyeing of this Example, the liquor is subsequently transferred to the dyeing vat, and thereupon the same amount of levelling agent is added. The dyeing temperature is brought to 97° to 98°.

5.36 g of the dye of the formula I, 2.28 g of the dye of the forula II and 2.28 g of the dye of the formula III, together dissolved in 200 ml of hot water, are fed in the course of ten minutes from a dropping funnel into the auxiliary vat. After a further 15 minutes, an addition is made by means of a flask burette, for 25 minutes at a rate of 1.4 ml per minute, of a total weight of 35 ml of 1 N sulphuric acid. The pH value after a further 10 minutes is 4.1. The pH value is continuously checked by means of the combined glass electrode incorporated into the circulation system.

The dyebath is exhausted, i.e. the dyes have been absorbed to the extent of over 99% onto the material being dyed. The heating is switched off and, with the aid of indirect cooling, the dye liquor is cooled to 60°. The almost colourless liquor is pumped back into the auxiliary vat and the piece beam is taken out. The filament fabric is unwound, dewatered by squeezing and dried.

The polyamide fabric is levelly dyed and, with regard to depth of colour and shade, does not differ from the dyeing carried out initially.

EXAMPLE 4

The apparatus shown in drawing 1 comprises a carpet winch vat (make "Brückner" type HKP, capacity max. 25.4 $m^3$, working width 5 m), which is provided with an external liquor circulation system. From the dyeing apparatus 1, the liquor is pumped through the suction piping 2 by means of the circulation pumps 3 and through the pipes 4 back to the dyeing apparatus, with a liquor-distributor with a spreading-trough 5 ensuring that the liquor on re-entering the dyeing apparatus is distributed as evenly as possible over the width of material. Into the pipes 4 are incorporated heat exchangers 6, a pH-measuring point 7—consisting of reference electrode type 8423 and glass electrode type 8403 (make "Polymetron"), previously calibrated at 20° by means of buffer solutions at the values of 4.00, 7.00 and 10.00—as well as a dosing device 8. This consists, as shown by drawing 2, of a storage tank 9, which is connected, by way of a shut off valve 10, a pump 11 (make "Bran & Lübbe", type Normados NK 31), a nonreturn valve 12, a further shut off valve 13 and an inoculating point 14, to the pipe 4. In addition, the dosing device is fitted with a safety valve 15.

The winch vat is filled to the extent of 80% with works water, and the water temperature in the vat is 18°. There are introduced into the vat 2 liters of antifoam agent and then successively 4.4 liters of sodium hydroxide solution 38° Baumé and 7.1 kg of an anionic auxiliary, each diluted with about 100 liters of water. 64 g of the dye of the formula I, 32 g of the dye of the formula III and 48 g of the dye of the formula II according to Example 1 are thereupon dissolved, with stirring, in 300 liters of hot water containing 30 g of Calgon dissolved, and quantitatively fed into the winch vat. After dyes, auxiliaries and chemicals have become well dispersed in the course of 5 minutes, a 220 meter length of polyamide-6.6 velvet pile carpet material having a width of 5 meters (carrier material: polypropylene strips) and a total weight of 710 kg is introduced into the winch vat. The winch speed is adjusted to 70–75 meters per minute, and the circulation rate of the liquor is between 6 and 7 cubic meters per minute.

The winch vat is allowed to run for 10 minutes without heating. It is then heated within 30 minutes to 90° and dyeing is performed for a further 30 minutes at 90° in order to ensure a uniform distribution of the dyes. The pH value of the liquor is 9.0, and the degree of exhaustion of the dyes is about 70%. By means of the dosing pump, 1 M sulphuric acid is added at the rate of 1.9 liters per minute for 18 minutes, after which time the pH value is 6.7, rising however in the next ten minutes to about 7.5. Samples are taken after 10 minutes, by which is established that there is no trace of unevenness (difference right side-middle-left side). This test takes 9 minutes. There are thereupon added, for 10 minutes at a rate of 0.95 liter per minute, then for 5 minutes at a rate of 1.6 liters per minute, and finally for 5 minutes at a rate of 2.5 liters per minute, 1 M sulphuric acid up to a pH value of the liquor of 4.2. After a further 5 minutes, there are again taken 3 samples which correspond, in shade and depth of colour to the production standard. The liquor is practically completely exhausted.

The liquor is now cooled by means of indirect cooling to 55° to 60°, and thereupon cooled to 43° by the addition of 20% of fresh water. The carpet material is run out, taken off and passed direct to the dryer. The dried carpet material is shown to be dyed in a level light-beige shade. As a result of the removal of the carpet material, about 1/5 of the amount of liquor is taken out with it. To the liquor at 43° are then added 2 liters of antifoam agent and 4.9 liters of sodium hydroxide solution of 38° Baumé, but the same amount of the anionic auxiliary and dyes. The measurements, type and weight of the carpet material are the same as those in the case of the first dyeing. The procedure carried out is essentially the same as that for the first dyeing, whereby the heating time and the dosing times were insignificantly shorter. The levelly dyed carpet material has a depth of colour and a shade which are identical to those of the first batch of material.

There are again introduced 2 liters of antifoam agent, 4.9 liters of sodium hydroxide solution 38° Baumé and this time 10.5 kg of the anionic auxiliary into the used liquor now at 44°. Into the winch vat are then fed 604 g of the dye of the formula I, 270 g of the dye of the formula III and 380 g of the dye of the formula II, dissolved in about 300 liters of hot water containing 30 g of Calgon. The identical carpet material which is then introduced weighs 712 kg. The procedure carried out is basically the same as hat in the case of the beige batch first described. The dried carpet material is dyed levelly in a lighter-brown shade.

The amount of water consumed in the winch vat in performing these three dyeings (without reckoning the cooling water for the indirect cooling of the liquor) is less than half the amount required for the same carpet dyeings when dyeing is performed by conventional processes. Furthermore, the content of organic substances in the waste liquor is very low.

It goes without saying that this method of procedure is scarcely feasible for production practice without an automatic system of control, since a continuous monitoring and adjusting of the pH value, of the dosing rate, etc., is necessary during the course of the process.

EXAMPLE 5

The apparatus shown in drawing 1 comprises a carpet winch vat (make "Brückner" type HKP, capacity max. 21.4 $m^3$, working width 4 m), which is provided with an external liquor-circulation system. From the dyeing apparatus 1, the liquor is pumped through the suction piping 2 by means of the circulation pumps 3 through the pipes 4 and back to the dyeing apparatus, with a liquor distributor fitted with a spreading-trough 5 ensuring that the liquor on re-entering the dyeing apparatus is distributed as evenly as possible over the width of material. Into the pipes 4 are incorporated heat exchangers 6, a pH-measuring point 7—consisting of reference electrode type 8423 and glass electrode type 8403 (made "Polymetron"), previously calibrated at 20° by means of buffer solutions at the values of 4.00, 7.00 and 10.00—as well as a dosing device 8. This consists, as shown in drawing 3, of a storage tank for acid 9, which is connected, by way of a shut-off valve 10, a pump 11 (make "Bran & Lübbe", type Normados NP 41), a nonreturn valve 12, a further shut-off valve 13 and an inoculating point 14, to the pipe 4.

On the storage tank for sodium hydroxide 23 is mounted a circulation pipe system with shut-off valve 24, pump 25 and reducing valve 26. From the circulating flow of alkaline solution there is fed, by means of a magnetic valve 27 controlled by the alkaline-solution controller 28, into the liquor-circulation system in pipe 4 the amount of alkaline solution necessary for the attainment of the initial pH value. The alkaline-solution controller receives the set point for the initial pH value from the set point programmer 22 and the actual level of the pH value from the electrodes 16, located in the pipe 4, via the measured-value transmitter 17. The actual value of the pH can be observed on the measuring instrument 18. The set point of the pH can be adjusted on the set point programmer 22 and also read off. The control of the acid pump 11 is effected by the controller 19 by means of a control motor 20, which, at constant stroke frequency, continuously adjusts the stroke between 0 to 100%. This controller receives the set point for the pH value, falling with increasing time, from the set point programmer 22, the actual value for the pH from the electrodes 16 via the measured-value transmitter 17, and the actual value of the pump-stroke setting from the position-feed-back potentiometer 21. The actual value of the pH at any time can be observed on the measuring instrument 18. The set point of the pH at any time can be read off on the set point programmer 22.

The operating part of the desired-value controller shown in drawing 4 consists of the following operating elements, which fulfill the following functions:

| Designation | | | Function |
|---|---|---|---|
| rotary knob with indication "pH-start" | | 30 | setting of the pH value at start of dyeing |
| press button | "start alkaline solution" | 31 | starting of the alkaline-solution dosing device |
| press button | "stop alkaline solution" | 32 | stopping of the alkaline-solution dosing device |
| indication | "pH actual" | 33 | indication of the instantaneous pH value in the dye liquor |
| indication | "pH set point" | 34 | indication of the pH set point |
| rotary knob with indication "G 1" | | 35 | setting of the pH gradient 1 (pH-$10^{-1}$ $min^{-1}$) |
| rotary knob with indication "pH-mean" | | 36 | setting of the pH value at which switching to "G 2" occurs |
| rotary knob with indication "G 2" | | 37 | setting of the pH gradient 2 (pH $10^{-1}$ $min^{-1}$) |
| rotary knob with indication "pH-final" | | 38 | setting of the pH value at end of dyeing |
| press button | "start acid" | 39 | starting of the acid-dosing device |
| press button | "stop acid" | 40 | stopping of the acid-dosing device |

Pilot lamps incorporated into the press buttons and mounted adjacent to the rotary knobs indicate the current status of the functions of the set point programmer.

Dyeings are performed analogously to Example 4 using this control and regulating apparatus. In the following are merely described details which relate to the control and regulating apparatus. The type and amounts of the dyes, auxiliaries and carpet material are analogous to those in Example 4.

The vat is charged with cold water, auxiliaries and dyes; the circulation pumps are allowed to run for 5 minutes; the alkaline-solution dosing device is then switched on, the apparatus is allowed to run for 10 minutes without heating, and subsequently the carpet material is introduced and the heating is switched on.

The initial pH value of 8.5 previously set on rotary knob 30 is reached after 15 minutes. The dyeing temperature of 95° is attained after a further 25 minutes, and the alkaline-solution dosing device is shut off. After a subsequent migration phase of 20 minutes, samples are taken and then the acid dosing device, with a value of 0.075 pH $min^{-1}$ adjusted on press button 35, is started. After a further 40 minutes, the "pH average" of 5.5 is attained, and the set point programmer switches over to the more rapid dosing rate G2 (button 37) of 0.1-pH $min^{-1}$. The final pH value of 3.5, set on press button 38, is reached after 20 minutes and is maintained until after sampling. After switching off the dosing device, the carpet is removed from the hot liquor and finished in the usual manner. The result is a level dyeing. The liquor is practically completely exhausted. As in Example 4, the dye liquor can be re-utilised. In further dyeings using this procedure, the gradients G1 and G2 are varied from 0.05 to 0.2 pH $min^{-1}$, and hence the effective dyeing times are varied between 1.5 hours and 3.5 hours.

Compared with the dosing device used in Example 4, the embodiment described above has the advantages that operating the apparatus is considerably simplified, and that the closed-loop control with programmed set point of the pH value is clearly less influenced by interference effects such as varying quality of water, concentration of acid and alkaline solution, and other similar factors.

EXAMPLE 6

A winch vat (make "Brückner" type H.K.P., capacity max. 21.4 $m^3$) is filled to the extent of 80% with works water. The water temperature is 18°. Into the vat are fed 2 liters of antifoam agent and subsequently 5.75 kg of a nonionic auxiliary (alkylaminopolyglycol ether), diluted with 100 liters of water.

The following are then dissolved with stirring in 300 liters of hot water:

1344 g of the dye of the formula I,
422 g of the dye of the formula II,
721 g of the dye of the formula III,
46.1 g of the dye of the formula IX

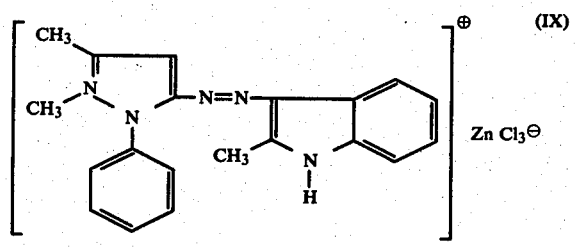

(IX)

12.7 g of the dye of the formula X

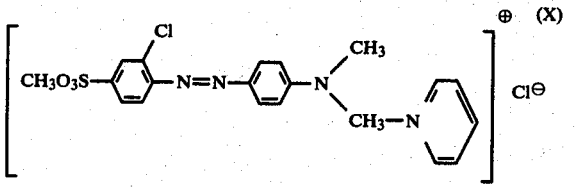

(X)

and 12.7 g of the dye of the formula XI

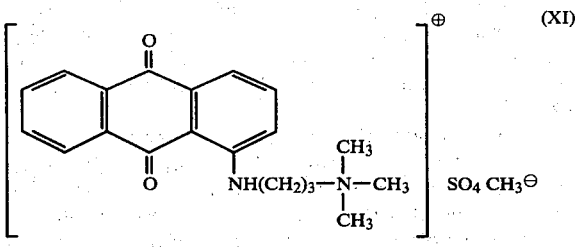

(XI)

and the solution is quantitatively introduced into the winch vat. The pH value is simultaneously adjusted to 8 by the controlled addition (for dosing device see Example 5) of 2 N sodium hydroxide solution. After dyes, auxiliaries and chemicals have become well dispersed within 5 minutes, a 260 meter length of polyamide-6.6 loop pile carpet material having a width of 4 meters and a total weight of 575 kg (carrier material: polypropylene strips), the loop pile of which is a 50:50 mixture of basically dyeable polyamide (Antron III, type 754) and deep-dyeing polymide (Antron III, type 757), is fed into the winch vat. The rotational speed is adjusted to 70–75 meters per minute. The liquor circulation is 6 to 7 cubic meters per minute. The winch vat is allowed to run during 5 minutes without heating. The temperature is then raised within 35 minutes to 94° C., and during this time the pH value of 8 is kept constant (measured at the respective temperature) by the controlled addition (dosing) of 2 N sodium hydroxide solution. After attainment of the final temperature, the dosing device is switched off and dyeing is subsequently performed at this temperature (94° C.) for 30 minutes in order to ensure a good surface levelness. Three samples are taken at the end of this phase to check the evenness of the dyeing (difference: right side—middle—left side). No differences of shade are found. By means of the dosing device (see Example 5), the pH value is lowered with 1 N sulphuric acid linearly from 8 to 6 within 40 minutes and from 6 to 3.5 within 15 minutes. Samples are taken after 10 minutes of pH stabilisation. The shade of colour (red-brown/beige), the depth of colour and the differentiation effect correspond exactly to the production sample. The dyebath is practically completely exhausted. The carpet material is now run out hot, taken off and passed directly to the dryer. The carpet material has a perfectly satisfactory surface levelness.

Re-utilisation

About 15 to 20% of the amount of liquor is lost with the carpet material on removal of this from the dyeing apparatus. This loss is made up by the addition of fresh water. There are again added to the liquor at 75° C., 2 liters of antifoam agent and subsequently 6.2 kg of the nonionic auxiliary (alkylaminopolyglycol ether), diluted with about 100 liters of water. The following are then dissolved or dispersed in 300 liters of hot water with stirring:

2439 g of the dye of the formula I,
1045 g of the dye of the formula II,
418 g of the dye of the formula III,
7667 g of the dye of the formula IV,
83 g of the dye of the formula V and
313 g of the dye of the formula VI, the resulting solution is quantitatively fed into the winch vat and the pH value is simultaneously adjusted to 8 by means of the controlled addition (dosing) of 2 N sodium hydroxide solution. After dyes, auxiliaries and chemicals have become well dispersed in the course of 5 minutes, a 285 meter length of polyamide-6.6 loop pile carpet material having a width of 4 meters and a total weight of 620 kg (same quality as in the case of dyeing 1) is introduced into the winch vat. The procedure carried out is essentially the same as that for the first dyeing, with it being possible however to reduce the heating-up time to about 10 minutes. The final pH value of the dyeing is adjusted to 4.1 and, after 10 minutes' pH stabilisation, samples are taken. The samples correspond in shade of colour—olive/golden-yellow—in the depth of colour and in the differentiation effect exactly to the production sample.

In consequence of the relatively high amounts of disperse dyes used, a complete exhaustion of the dyes is not possible in this case; no further re-utilisation of the liquor is therefore undertaken. The carpet material displays a fully satisfactory surface levelness.

We claim:

1. In a process for the level dyeing of synthetic polyamide textile material by exhaustion in an aqueous dyebath using an anionic, metal-free, non-fiber-reactive dyestuff, the improvement which comprises (1) contacting the textile material with the dyebath at a pH value in the range of 6 to 12, (2) during the dyeing, exhausting the dyestuff onto the textile material by lowering the pH by at least one pH unit by the addition of an inorganic acid having a pKa value of less than 3.8 at 20° C., (3) separating the dyed textile material from the exhausted dyebath (4) adding to the exhausted dyebath additional dyestuff and sufficient alkali to adjust the dyebath pH value to the range of 6 to 12, and (5) repeating steps (1) and (2).

2. The process of claim 1, wherein the synthetic polyamide textile material is carpeting.

3. Process according to claim 1, wherein the acid is added continuously at a constant rate.

4. Process according to claim 1, wherein the acid is added continuously at different rates.

5. Process according to claim 1, wherein the addition of acid is periodically discontinued.

6. Process according to claim 1, wherein the acid is so added that a constant change of the pH value relative to time or temperature occurs in such a manner that one or more linear or nonlinear gradients result.

7. Process according to claim 1, wherein sulphuric acid is used.

8. Process according to claim 1, wherein at the commencement of dyeing the pH value is brought to the initial value by the controlled addition of a strong alkaline solution.

9. Process according to claim 8, wherein there is used an alkaline solution of which the $pK_a$ value at 20° C. is above 9.2.

10. Process according to claim 1, wherein the bath is used two to six times.

* * * * *